US005542560A

United States Patent [19]

Gerster et al.

[11] Patent Number: 5,542,560

[45] Date of Patent: Aug. 6, 1996

[54] PROTECTIVE AND WARMING BONNET FOR FOOD

[76] Inventors: Peter Gerster, Kohlplatzweg 16, CH-4310 Rheinfelden; Kurt Zimmerli, Dorfstrasse, CH-8532 Warth, both of Switzerland

[21] Appl. No.: 296,966

[22] Filed: Aug. 26, 1994

[30] Foreign Application Priority Data

Aug. 27, 1993 [CH] Switzerland ..... 02556/93

[51] Int. Cl.[6] ..... B65D 51/06; B65D 25/32; F24C 15/20

[52] U.S. Cl. ..... 220/252; 220/731; 220/760; 126/299 C

[58] Field of Search ..... 220/252, 283, 220/334, 730–731, 760; 160/132, 134, 84.04, 56, 352; 126/299 C, 299 R; 99/645

[56] References Cited

U.S. PATENT DOCUMENTS

| | | | |
|---|---|---|---|
| 1,126,236 | 1/1915 | Lees | 160/132 |
| 2,080,786 | 5/1937 | Robles | 220/252 |
| 2,250,729 | 7/1941 | Smith et al. | 220/252 |
| 2,428,839 | 10/1947 | Salino | 220/252 |
| 2,614,718 | 10/1952 | Loop | 220/252 |
| 3,229,846 | 1/1966 | Katz | 220/252 |
| 4,422,441 | 12/1983 | Schoepe | 220/252 X |

FOREIGN PATENT DOCUMENTS

| | | | |
|---|---|---|---|
| 239634 | 10/1911 | Germany | 220/252 |

*Primary Examiner*—Allan N. Shoap
*Assistant Examiner*—Nathan Newhouse
*Attorney, Agent, or Firm*—Speckman, Pauley & Fejer

[57] ABSTRACT

A protective and warming bonnet for food having two, preferably, semi-circularly curved braces 1,2 whose ends are connected to hinges (5,6). These braces may be pivoted from 0° to a maximum of 180° in relation to one another. A folding bellows 4 is arranged between the two braces 1,2 such that when pivoted apart, the braces 1,2 form a bellows-like dome. In one embodiment, the protective and warming bonnet has a continuous base 14 in the form of a serving platter on which the braces 1,2 rest during use. A carrying handle 13 of round-steel or a tube is hooked to the hinges 5,6 on the braces 1,2. This carrying handle 13 rests in a notch or a slot at the hinge 5,6 so that it is no longer pivotable in relation to the base while under the pressure resulting from carrying such.

13 Claims, 4 Drawing Sheets

PROTECTIVE AND WARMING BONNET FOR FOOD

BACKGROUND OF THE INVENTION

1. Field of the Invention

This invention relates to a device for covering food on plates, platters or in bowls.

2. Description of the Prior Art

Covering devices in the form of bells, cheese covers and insect bonnets are known. Their purpose is to keep food fresh and to protect it from dust, odors and insects. For fruit, for example, bonnets made of wire frames covered with a fabric that is permeable to air are available. Some of these bonnets may be opened like an umbrella. In order to protect; food such as cheese or tarts from becoming stale by exposure to the air, covers in the form of food bells, made of plastic or glass are used. Food bells are also used to keep foods warm. Restaurants very often use metallic, semi-circular, and frequently very large covering bells which are intended not only to prevent rapid cooling of the foods but are often decorative as well.

One drawback of solid covering bells and bonnets is their size and the space required to store them. An additional problem with heat-retaining covering bells is that they are very expensive if they are made to be decorative. It is precisely for these reasons that private households and many restaurants do without food bells, although they are very advantageous in serving foods outdoors.

SUMMARY OF THE INVENTION

It is an object of this invention to provide a protective and warming bonnet for food which saves storage space, is decorative and may be manufactured at a reasonable cost.

This object is achieved with a protective and warming bonnet for food that has two curved braces whose ends are connected to hinges and which are pivotal from 0° to a maximum of 180° in relation to one another. A folding bellows is arranged such that, in the expanded state, the braces form a dome.

BRIEF DESCRIPTION OF THE DRAWINGS

Preferred embodiments of the protective and warming bonnet are illustrated by way of the drawings wherein.

DESCRIPTION OF PREFERRED EMBODIMENTS

Figure 1:
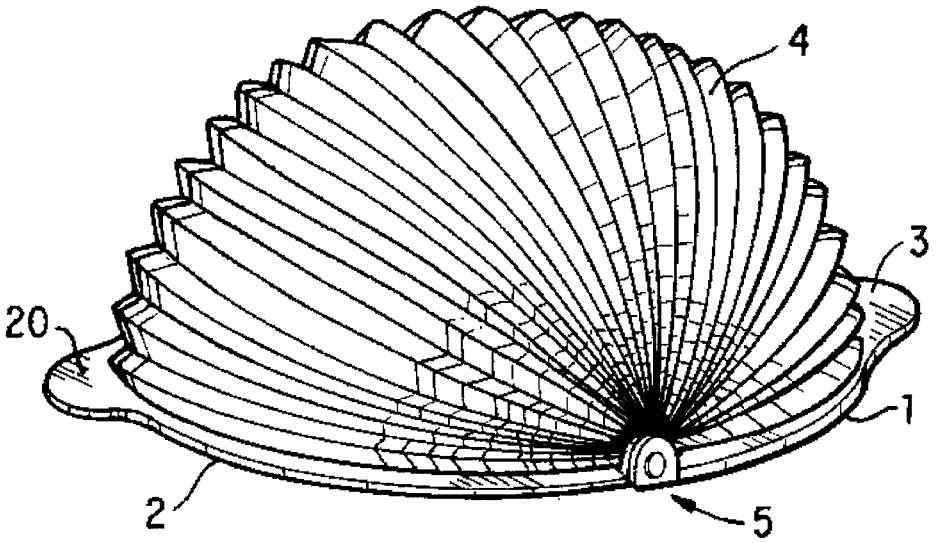
FIG. 1 shows one preferred embodiment of the protective and warming bonnet unfolded over a plate.

FIG. 1 shows a simple basic model of the protective and warming bonnet in the operating position according to one preferred embodiment of this invention. In the example shown, it comprises two semi-circular braces 1 and 2, which are connected at their ends to hinges 5,6. These braces 1,2 are pivotal in relation to one another from 0° to a maximum of 180°. A folding bellows 4 is arranged between the two braces 1,2 in such a manner that when the braces 1,2 are pivoted apart, a bellows-like dome is formed which, depending on the size of the bonnet, provides sufficient space for a plate, or a serving platter, or a bowl.

Figure 2:
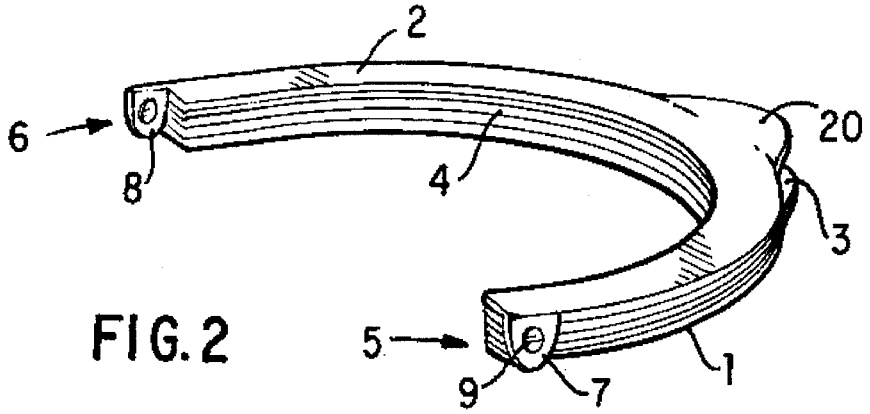
FIG. 2 shows the protective and warming bonnet, of FIG. 1, in the folded state.

FIG. 2 shows the protective and warming bonnet shown in FIG. 1 in the folded state. Between the two braces, 1,2, which in this preferred embodiment are made of punched steel plates, is the folded bellows 4. The flat surfaces of the braces 1,2 extend approximately parallel to one another in this state. Braces 1,2 are each provided with a central projection, located on the outer perimeter of the semi-circle, which form handles 3,20. These handles 3,20 facilitate the opening and folding of the protective bonnet. In the operating position, the handles 3,20 are slightly bent so that they may be easily grasped. Swung into the closed position, as shown in FIG. 2, they are slightly bent toward one another. The hinges 5,6 are formed by brackets 7,8 which are bent at right angles from the ends of the braces 1,2. The brackets 7 of the brace 2, which in FIG. 2 lies on top of brace 1, each form a hole. The brackets 8 of the brace 1, which in this figure lies below the brace 2, each comprise a pin 9. Alternatively, brackets 8 of brace 1 each form a hole and brackets 7 of brace 2 each comprise a pin 9. By slightly pressing the braces 1,2 together or expanding the braces 1,2 by means of the outer bracket, the pins 9 may be inserted during assembly into the holes in which they are then maintained in the unstretched state of the material.

Figure 3:
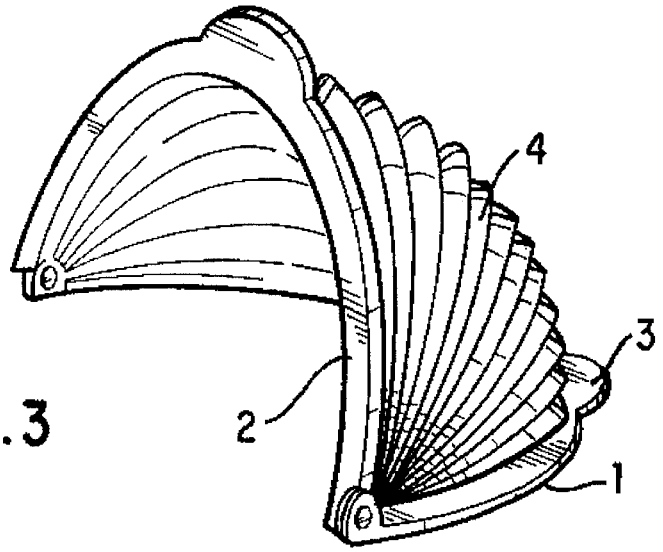
FIG. 3 shows the protective and warming bonnet, of FIG. 1, in the half-opened state.

FIG. 3 shows the protective and warming bonnet in the half-opened state. The braces 1,2 may be made of a variety of materials such as steel, aluminum, plastic, plexiglass, or wood. In order to make the braces 1,2 decorative, their surfaces may be lacquered, finished with a metal or anodized. The handles 3,20 may also be configured in a decorative manner and could be lacquered, for example, in a different color, than the braces 1,2 or additional shapes might be mounted to the integrated handles 3,20. Such shapes may be made of various materials such as metal, wood or plastic, and they may be glued or screwed on, for example. The folding bellows 4, which, depending on use, may comprise a wide range of materials, is replaceably fastened to braces 1,2. In the preferred embodiment shown in FIG. 3, the folding bellows 4 is made of pleated paper, in the manner of Chinese lanterns, and affixed to the braces 1,2 by an adhesive strip. Another possible way of fastening the folding bellows 4 to the braces 1,2 is with a Velcro® strip. The folding bellows 4 may thus be replaced and reused. If the protective bonnet is used to cover fruit, the folding bellows 4 is preferably made of a material that is permeable to air. A folding bellows made of strong transparent plastic sheets, which may be pleated like a paper folding bellows, is suitable for the protection of cold foods. This type of folding bellows is particularly attractive and decorative because it allows the food to be seen. Opaque bellows may have a graphic design. A folding bellows made of multicolored paper is particularly suitable for garden parties. It serves to protect the food from dust and insects and from cooling too quickly, and also provides attractive and decorative table embellishment. The folding bellows 4 may also be used as an advertising surface and be provided with pictures and advertisement text which, in the opened state, are transmitted as advertising messages. An interesting opportunity is thus provided to restaurants and hotels for emphasizing their identity with their own imprint on the folding bellows 4. For special occasions that have a theme, such as birthdays, company anniversaries and club festivities, special effects may be obtained with very specific imprints. Thus, it is possible to provide folding bellows that have names or dates or company logos imprinted, etc. If the protective bonnet is used to prevent heat loss, the folding bellows may be made of a special heat-insulating material such as a thin metal-covered sheet. This thin sheet may also be configured with advertising. The folding bellows 4 basically follows the form of the braces 1,2. The braces 1,2 shown in the drawing are semi-circular. However, the braces 1,2 may also have an elliptical or even rectangular shape. The form of each folding bellows used depends on the shape of the braces 1,2.

The variety of materials and shapes of which the braces 1,2 and the folding bellows 4 may be made also provide a variety of applications for the protective and warming bonnet of this invention. In addition to its practical use as protection against dust, odor, irradiation from the sun, insects, and heat loss, the protective bonnet is particularly suitable as a decorative way of serving and as table embellishment which may impart a completely new and refreshing aspect to any table setting. The combination of colors with a corresponding napkin or even matching them with the foods being served opens new horizons to the gastronome for pampering his guests. The field of application for this protective and warming bonnet extends from the dining room in a private household to the balcony or the garden, and even further to the catering business and to camping. Based on the variety of possible configurations and the simple construction of the protective bonnet, it is apparent that it is also possible to make inexpensive models. On the other hand, it is also possible to construct literally luxury models having chrome or gold-plated braces and a folding bellows made of a thin metal sheet or a transparent plastic sheet.

Figure 4:
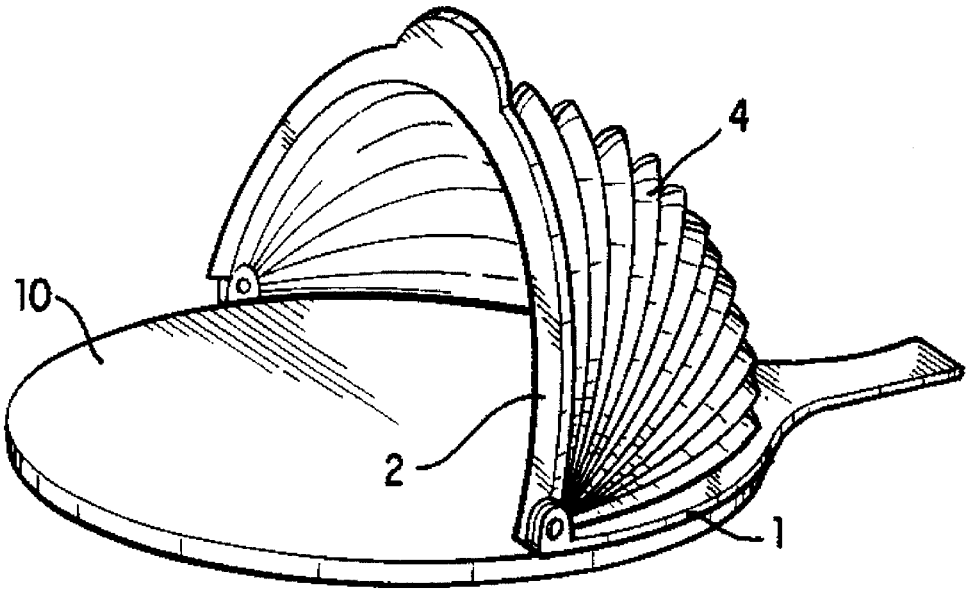
FIG. 4 shows the protective and warming bonnet integrated with a base plate, according to another preferred embodiment of this invention.

FIG. 4 shows the protective and warming bonnet in accordance with one preferred embodiment of this invention integrated, for example, with a wooden base plate 10. One brace 1, in this case, is securely connected to the base plate 10, while the other brace 2 is freely pivotal by 180°, unfolding the folding bellows 4 which lies between them. In order to allow the base plate 10 to be cleaned, the brace 1 may also be fastened to the base plate 10 in a removable manner, for example, by clamps, snaps, thumb screws, nuts, magnets or other means. The base plate 10 may also serve in the kitchen for trimming and cutting food. The bonnet is then closed until the food is served. In this manner, it is possible to neatly serve food such as assorted cheeses, cold cuts, sausages and fruit. The base plate 10 may also serve as an individual plate. It may be placed on the table before the guests and the bonnet then opened to achieve the effect of surprise. The base plate 10 may also be a small table top. In this preferred embodiment, the two braces 1,2 correspond to the table top. Brace 1 is mounted to the table top and, if brace 2 is flipped over, the entire table is covered.

Figure 5:
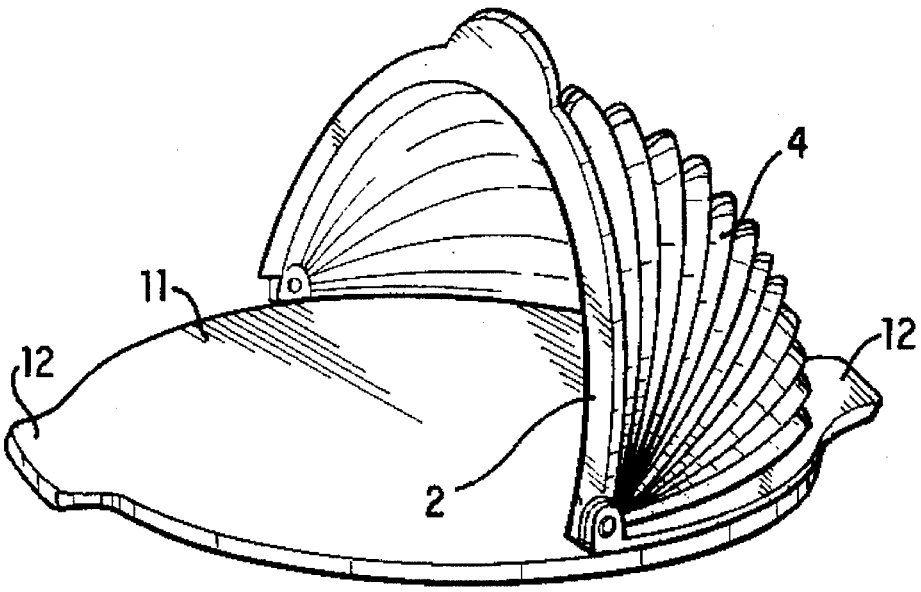
FIG. 5 shows the protective and warming bonnet integrated with a serving platter, according to another preferred embodiment of this invention.

FIG. 5 shows another preferred embodiment in which the protective and warming bonnet is arranged on a conventional platter 11 for preparing and serving, platter 11 having two handles 12. In this preferred embodiment, brace 1 is again securely connected to platter 11, while the other brace 2 is freely pivotal. The platter 11 for preparing food may also be made of chrome steel, silver, glass, wood or plastic. Souffles may be kept warm and served, if a platter or a somewhat deeper container or glass bowl is used. The protective and warming bonnet in this embodiment is fastened by suitable fastening means to the platter 11 or the bowl, respectively. These fastening means may be, for example, clamps or snaps.

In accordance with one particularly preferred embodiment, the protective and warming bonnet, including the covered food, is portable.

Figure 6:
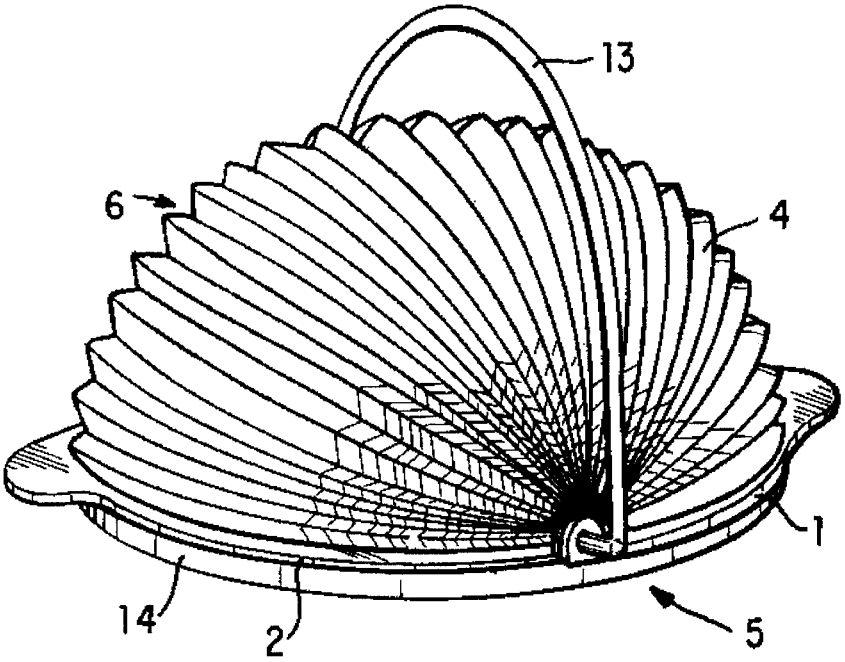
FIG. 6 shows the protective and warming bonnet including a carrying handle, according to another preferred embodiment of this invention.

FIG. 6 shows another embodiment of a protective bonnet in accordance with this invention with a carrying handle 13. The carrying handle 13 comprises round steel or a tube and is connected to the hinges 5,6. In accordance with this embodiment, the protective and warming bonnet is provided with base 14 on which one brace 1 is securely mounted, while the other brace 2 is again freely pivotal. The carrying handle 13 may be mounted such that under pressure it engages a notch or a slot in each of the hinges 5,6 and, as a consequence, is no longer pivotal with respect to base 14 and thus there is no danger that the base will tilt during carrying. When the bonnet is empty, the carrying handle 13 may be pivoted to either side. This embodiment makes it particularly easy to serve meals on plates. One person can carry two bonnets including the plates disposed under them or a plurality of bonnets may by hung by their carrying handles from a carrying rod. In another preferred embodiment, the base may be provided with a removable hook to which the carrying handle of an additional protective bonnet having a base 14 may be hung. This allows one person to carry at least four covered meals on plates to the guest table where they may be served.

Figure 7:
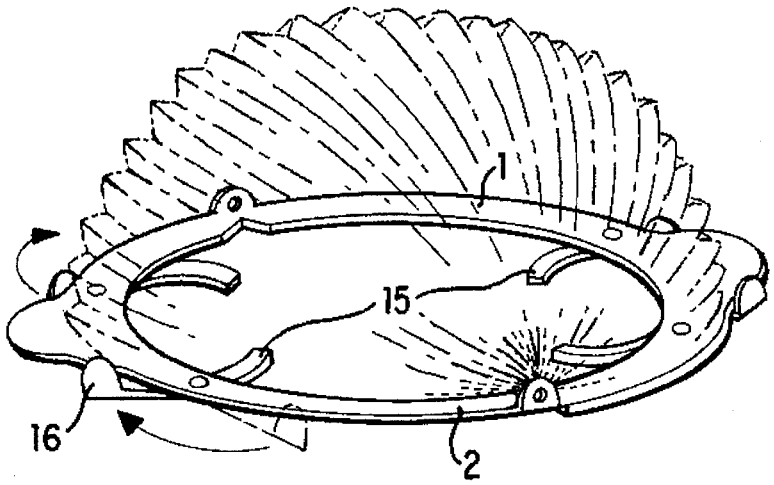
FIG. 7 shows the protective and warming bonnet including a plate holder, according to another preferred embodiment of this invention.

FIG. 7 shows another preferred embodiment of the protective and warming bonnet of this invention which allows a covered meal on a plate to be carried. To hold the plate, four pivotable gripping arms 15 are mounted to the braces 1, 2. After the protective and warming bonnet is placed over a meal on a plate, the gripping arms 15 are pivoted into the position shown in FIG. 7 by pivoting back the handles 16. Thus, the ends of the gripping arms 15 grip under the edge of the plate, and the protective and warming bonnet including the plate disposed below it may be carried away by the carrying handle 13.

Figure 8:
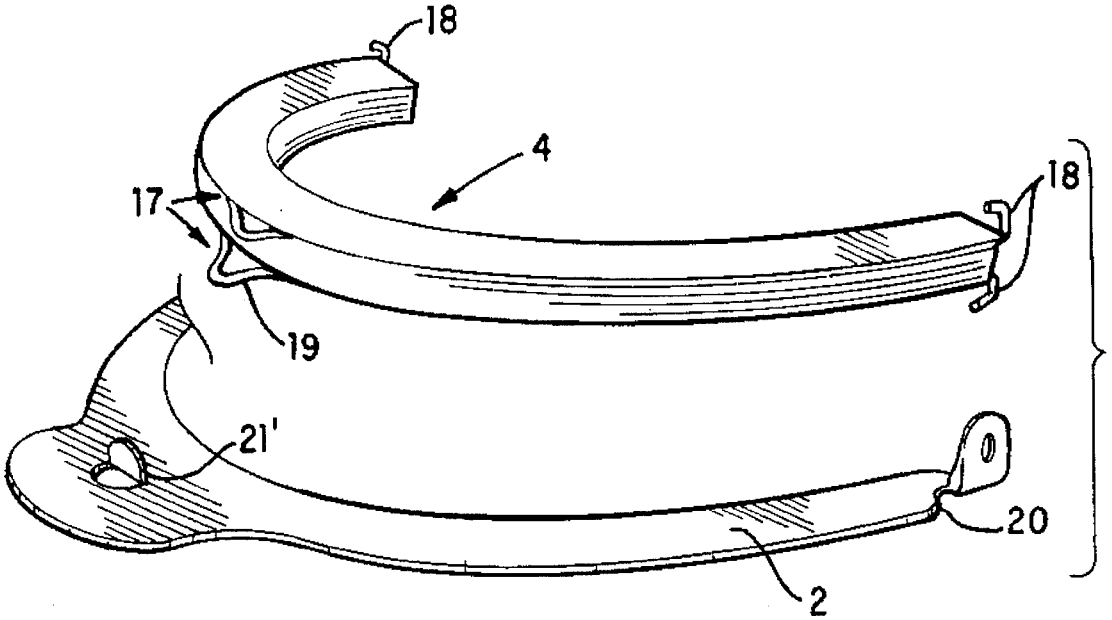
FIG. 8 shows the protective and warming bonnet including the fastening means for a paper folding bellows, according to another preferred embodiment of this invention.

FIG. 8 shows a protective and warming bonnet in accordance with another preferred embodiment of this invention comprising a fastening means for a paper folding bellows 4. In most cases, the paper folding bellows 4 are made in the manner of paper lanterns and have a wire frame 17 at both ends. The ends of this wire frame 17 are bent in such a way as to form hooks 18. In the middle of the wire frame 17, hooks 18 are shaped to form a wire bracket 19. FIG. 8 shows a brace 2 below the folding bellows 4. The folding bellows 4 is placed on this brace 2 for mounting. In this embodiment, recesses 20 into which the hooks 18 may be hooked are provided in the region of the hinges 5,6. After this is accomplished on both sides, the wire bracket 19 is pulled over a barb 21' which is punched out of brace 2 and is hooked in under slight pressure. In this manner, the folding bellows 4 may be exchanged and replaceably mounted again to braces 1,2. The folding bellows 4 is mounted in the same manner to the opposite brace.

Figure 9:
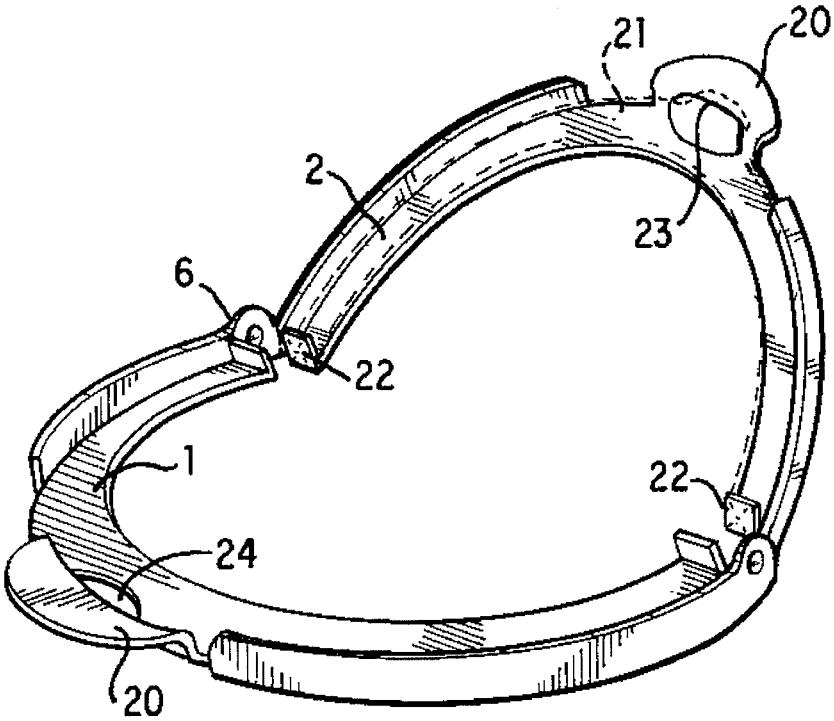
FIG. 9 shows the braces Of the protective and warming bonnet for a replaceable paper folding bellows.

FIG. 9 shows the braces of the protective and warming bonnet for a replaceable paper folding bellows in accordance with yet another preferred embodiment. In this embodiment, the paper folding bellows made in the manner of a paper lantern is glued at both ends to bow-shaped strips of cardboard 21. One cardboard strip 21 is indicated in FIG. 9 by the dashed line. The bow-shaped cardboard strip 21 has the same shape and size as the flat surface of the brace 1,2 and is provided with a projecting bracket 23 in the polar region. The curved braces 1,2 are made of punched metal pieces whose cross-sectional profile is L-shaped, so that they have an outer edge which is bent upward by 90°. In the region of the hinges 6, the flat surfaces of the braces 1,2 are bent upward such that upward-bent section 22 and the flat surface of the brace 1,2 form an approximately 45° angle. Furthermore, the braces 1,2 which are formed of one piece are provided with a handle 20 in each of the polar regions. In the region of the handles 20, the L-profile of the braces 1,2 is perforated in such a way that a slot-shaped opening 24 is formed by the flat surface of the brace 1,2. During insertion of the folding bellows 4 into the braces 1,2, the cardboard strips 21 are placed with their ends below the upward-bent sections 22 of the brace 1,2. The bracket 23 of the cardboard strip 21 is inserted into the opening 24 of the braces 1,2 by slightly pressing the cardboard strips together into the opening 24 of the braces 1,2. Once the bracket 23 is pushed into the opening 24, the cardboard strip 21 and, thus, the folding bellows 4, are supported by the braces. The same process is repeated for the second cardboard strip. Once both cardboard strips are fastened in the braces, the protective cover is ready to use. In the folded state, the folding bellows 4 is enclosed by the L-profiles of the braces 1,2 and is thus protected. This has the advantage of protecting the bonnet during storage. This simple means of mounting the folding bellows 4 to the braces 1,2 allows a rapid and problem-free exchange when the folding bellows 4 needs to be replaced.

Depending on use, the folding bellows 4 may also be made of a transparent sheet. Food is thus protected and may be displayed as is commonly done at self-service buffets, with the bonnet being opened only when foods are removed. Depending on the size of the protective bonnet a portion of a buffet may also be covered. There are many ways in which the protective bonnet according to the invention may be used. The folding bellows 4 may be disassembled for cleaning. A damaged folding bellows is also easily replaceable. Foods are decoratively and hygienically presented due to the use of the protective bonnet and the use of the corresponding folding bellows 4. In an embodiment not shown here, the protective bonnet may be placed on a cooking utensil, such as a skillet or deep-frying pan. The protective cover in this case may either be an integral part of the skillet or may be assembled to be attached and detached again. If used in this manner, the protective cover serves as a splatter protection during sautéing or deep-frying. In this preferred embodiment, the folding bellows comprises a sieve-like metal fabric or filter paper. The folding bellows made of metal fabric may be removed after use, cleaned and reused. A soiled paper folding bellows may be easily replaced by a new one.

We claim:

1. A protective and warming bonnet comprising: two curved braces (1,2) connected at their ends by hinges (5,6) and pivotal from 0° to a maximum of 180° in relation to one another, a folding bellows (4) disposed between the two curved braces (1,2) whereby, when the curved braces (1,2) are pivoted apart, a dome is formed, the curved braces (1,2) comprising punched metal sheets having a cross-sectional profile that is L-shaped and having a flat surface with an upward-bent section (22) in the region of the hinges (5,6) such that the upward-bent section (22) forms an approximately 45° angle with the flat surface of the curved brace (1,2), and in the polar region, a handle (20), the L-profiles of the curved braces (1,2) in the polar region forming a slot-shaped opening (24), and wherein the folding bellows (4) is exchangeable and reusable, said folding bellows (4) fixedly secured to a cardboard strip (21) having two end portions, the two end portions positioned below the upward-bent sections (22) of one of the curved braces (1,2), and a bracket (23) projecting from the polar region of the cardboard strip (21) positioned in the slot-shaped opening (24) of the curved brace (1,2).

2. A protective and warming bonnet according to claim 1, wherein the curved braces (1,2) comprise punched metal pieces which, when pivoted apart, rest flat against a table and whose flat surfaces, when pivoted together, are substantially parallel to one another and enclose folded-up said folding bellows (4).

3. A protective and warming bonnet according to claim 1 further comprising a base (14) upon which the curved braces (1,2) rest in an operating state, each of the hinges (5,6) forming a notch or slot, a carrying handle (13) having two end portions, each end portion engaging one said notch or slot, the two end portions under the pressure of a load engaging the notches or slots such that the carrying handle (13) is no longer pivotal in relation to the base 14.

4. A protective and warming bonnet according to claim 1, wherein one of said curved braces (1) is secured to one of a base plate and a serving platter (10,11), and the other of said curved braces (2) is freely pivotal away from the opposite side of the base plate or serving platter (10,11) while the folding bellows (4) is unfolding.

5. A protective and warming bonnet according to claim 1, wherein a plurality of pivotal gripping arms (15) are attached to the curved braces (1,2), the gripping arms (15) being pivotal under a plate lying under the bonnet such that the plate and bonnet may be carried by the gripping arms (15).

6. A protective and warming bonnet according to claim 1, wherein the folding bellows (4) is constructed from a material selected from the group consisting of a pleated paper, a transparent thin sheet material, plastic sheets, metal sheets and a textile fabric.

7. A protective and warming bonnet according to claim 1, wherein the folding bellows (4) comprise one of heat-insulating plastic and a metal-sheet material.

8. A protective and warming bonnet comprising two curved braces (1,2) connected at their ends by hinges (5,6) and pivotal from 0° to a maximum of 180° in relation to one another, a folding bellows (4) disposed between the two curved braces (1,2) whereby, when the curved braces (1,2) are pivoted apart, a dome is formed, a base (14) upon which the curved braces (1,2) rest in an operating state, each of the hinges (5,6) forming a notch or slot, a carrying handle (13) having two end portions, each end portion engaging one said notch or slot, the two end portions under the pressure of a load engaging the notches or slots such that the carrying handle (13) is no longer pivotal in relation to the base 14.

9. A protective and warming bonnet according to claim 8, wherein the folding bellows (4) is constructed from a material selected from the group consisting of a pleated paper, a transparent thin sheet material, plastic sheets, metal sheets and a textile fabric.

10. A protective and warming bonnet according to claim 8, wherein the folding bellows (4) comprise one of heat-insulating plastic and a metal-sheet material.

11. A protective and warming bonnet according to claim 8, wherein one of said curved braces (1) is secured to one of a base plate and a serving platter (10,11), and the other of said curved braces (2) is freely pivotal away from the opposite side of the base plate or serving platter (10,11) while the folding bellows (4) is unfolding.

12. A protective and warming bonnet comprising two curved braces (1,2) connected at their ends by hinges (5,6) and pivotal from 0° to a maximum of 180° in relation to one another, a folding bellows (4) disposed between the two curved braces (1,2) whereby, when the curved braces (1,2) are pivoted apart, a dome is formed, wherein the folding bellows (4) is exchangeable and reusable, said folding bellows (4) comprising a wire frame (17) which is set in an edge of the folding bellows (4), said wire frame (17) having two bent end portions, the hinge (5,6) regions of the curved braces (1,2) forming hinge bores, one of the two bent end portions hooked into one of the hinge bores and the other of the two bent end portions hooked into the other hinge bore, the wire frame (17) forming a bracket (19) at a center of the wire frame (17), and the bracket (19), under pressure, may be hooked into a barb (21') on the curved brace (1,2).

13. A protective and warming bonnet comprising two curved braces (1,2) connected at their ends by hinges (5,6) and pivotal from 0° to a maximum of 180° in relation to one another, a folding bellows (4) disposed between the two curved braces (1,2) whereby, when the curved braces (1,2) are pivoted apart, a dome is formed, a plurality of pivotal gripping arms (15) attached to the curved braces (1,2), and the gripping arms (15) being pivotal under a plate lying under the bonnet such that the plate and bonnet may be carried by the gripping arms (15).

* * * * *